US008384371B2

(12) United States Patent
Rose

(10) Patent No.: US 8,384,371 B2
(45) Date of Patent: Feb. 26, 2013

(54) VARIOUS METHODS AND APPARATUSES FOR AN INTEGRATED ZIG-ZAG TRANSFORMER

(75) Inventor: Jeffrey David Rose, San Jose, CA (US)

(73) Assignee: Rosendin Electric, Inc., San Jose, CA (US)

( * ) Notice: Subject to any disclaimer, the term of this patent is extended or adjusted under 35 U.S.C. 154(b) by 456 days.

(21) Appl. No.: 12/720,617

(22) Filed: Mar. 9, 2010

(65) Prior Publication Data

US 2011/0148391 A1 Jun. 23, 2011

Related U.S. Application Data

(60) Provisional application No. 61/287,856, filed on Dec. 18, 2009.

(51) Int. Cl.
*H01F 30/12* (2006.01)

(52) U.S. Cl. ..... 323/361; 336/5

(58) Field of Classification Search ..... 323/355, 323/361; 363/148, 152–156, 170–171; 336/5, 336/12, 10

See application file for complete search history.

(56) References Cited

U.S. PATENT DOCUMENTS

| | | | | |
|---|---|---|---|---|
| 5,801,610 | A * | 9/1998 | Levin | 336/12 |
| 7,969,265 | B2 * | 6/2011 | Johnson, Jr. | 336/5 |
| 2003/0197989 | A1 * | 10/2003 | Nojima | 361/47 |
| 2005/0253564 | A1 * | 11/2005 | Choi | 323/207 |
| 2006/0028187 | A1 * | 2/2006 | Kim | 323/272 |
| 2007/0290670 | A1 * | 12/2007 | Lee | 323/361 |
| 2009/0251932 | A1 * | 10/2009 | Owen | 363/44 |

* cited by examiner

*Primary Examiner* — Adolf Berhane
*Assistant Examiner* — Jeffrey Gblende
(74) *Attorney, Agent, or Firm* — Rutan & Tucker, LLP

(57) ABSTRACT

A method, apparatus, and system in which a neutral deriving transformer incorporates a zig-zag transformer configuration is provided. A zig-zag transformer provides an electrical load with a neutral wire. The zig-zag transformer may be electrically connected downstream of a main AC voltage step-down transformer. Additionally, three phase AC voltage lines can be routed to the zig-zag transformer such that the zig-zag transformer comprises a neutral deriving transformer that electrically connects to a ground conductor. The neutral deriving transformer might not be electrically connected to a neutral conductor of the main voltage step-down transformer. The zig-zag transformer can phase shift each winding by approximately 120 degrees and may derive a neutral for at least one single phase load connected to the zig-zag transformer and one of the three phase AC lines in order to provide a common neutral point that takes the place of a neutral cable that connects back to the main AC voltage step-down transformer.

20 Claims, 6 Drawing Sheets

VARIOUS METHODS AND APPARATUSES FOR AN INTEGRATED ZIG-ZAG TRANSFORMER

RELATED APPLICATIONS

This application claims the benefit of U.S. Provisional Patent Application No. 61/287,856, filed Dec. 18, 2009, and entitled "VARIOUS METHODS AND APPARATUSES FOR AN INTEGRATED ZIG-ZAG TRANSFORMER."

FIELD OF THE INVENTION

Embodiments of the invention generally relate to electrical power supply.

More particularly, an aspect of an embodiment of the invention relates to methods and apparatuses for an integrated zig-zag transformer.

BACKGROUND OF THE INVENTION

Routing of cabling during construction of a building as well as post construction of that building can take a long time, be expensive with the time and material involved, as well as have to adhere to numerous code requirements to route that cabling. However, the traditional stages of constructing a building can be altered with some creative thinking.

SUMMARY OF THE INVENTION

Some embodiments of the systems and methods described herein relate to a neutral deriving transformer incorporating a zig-zag transformer configuration. For example, an electrical power distribution system may include a zig-zag transformer providing an electrical load with a neutral wire. The zig-zag transformer can be electrically connected downstream of a main AC voltage step-down transformer. Additionally, three phase AC voltage lines can be routed to the zig-zag transformer such that the zig-zag transformer comprises a neutral deriving transformer that electrically connects to a ground conductor. The ground conductor may tie back to a ground for the main voltage step-down transformer. In some embodiments, the neutral deriving transformer does not electrically connect to a neutral conductor of the main voltage step-down transformer, however. The zig-zag transformer phase shifts each winding by approximately 120 degrees such that the zig-zag transformer is a phase shifting series autotransformer that derives a neutral for all single phase loads connected to both the zig-zag transformer and all of the three phase AC lines in order to provide a common or neutral point that takes the place of a neutral cable that electrically connects back to the neutral conductor of the main voltage step-down transformer. Additionally, the zig-zag transformer can be electrically connected into a building's power distribution system downstream of the building's main voltage step-down connection to the Electric Power Utility grid.

BRIEF DESCRIPTION OF THE DRAWINGS

The drawings refer to embodiments of the invention in which.

Figure 1A:
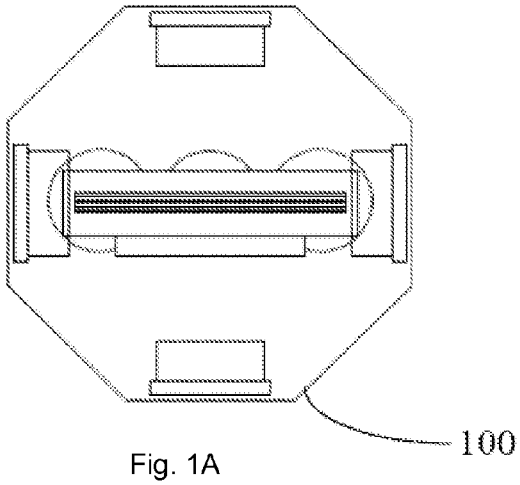
FIGS. 1A-1C illustrate a diagram of a zig-zag transformer system in accordance with the systems and methods described herein.

While the invention is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the invention.

DETAILED DISCUSSION

In the following description, numerous specific details are set forth, such as examples of specific data signals, named components, connections, amount of zig-zag transformers, etc., in order to provide a thorough understanding of the present invention. It will be apparent, however, to one of ordinary skill in the art that the present invention may be practiced without these specific details. In other instances, well known components or methods have not been described in detail but rather in a block diagram in order to avoid unnecessarily obscuring the present invention. Further specific numeric references such as first enclosure, may be made. However, the specific numeric reference should not be interpreted as a literal sequential order but rather interpreted that the first enclosure is different than a second enclosure. Thus, the specific details set forth are merely exemplary. The specific details may be varied from and still be contemplated to be within the spirit and scope of the present invention.

In general, a neutral deriving transformer is described. Generally, a neutral deriving transformer may incorporate a zig-zag transformer configuration. In such a configuration, the zig-zag transformer may provide an electrical load with a neutral wire by electrically connecting downstream of a main AC voltage step-down transformer. Additionally, three phase AC voltage lines can be routed to the zig-zag transformer. The ground conductor may tie back to a ground for the main voltage step-down transformer. The neutral deriving transformer does not electrically connect to a neutral conductor of the main voltage step-down transformer. The zig-zag transformer phase shifts each winding by approximately 120 degrees such that the zig-zag transformer is a phase shifting series autotransformer that derives a neutral for both all single phase loads connected to the zig-zag transformer and all of the three phase AC lines in order to provide a common neutral point that takes the place of a neutral cable that electrically connects back to the neutral conductor of the main voltage step-down transformer. Additionally, various embodiments relate to a grounded zig-zag transformer, where a neutral common point of the windings of the zig-zag transformer is grounded. Various other embodiments relate to an ungrounded zig-zag transformer, where a neutral common point of the windings of the zig-zag transformer is ungrounded. The zig-zag transformer may also be installed in parallel with a system such that a set of coils from the zig-zag transformer is electrically in parallel with a load of the zig-zag transformer. In such an embodiment, the set of coils may provide a return path for current flowing through the load of the zig-zag transformer.

Figure 1B:
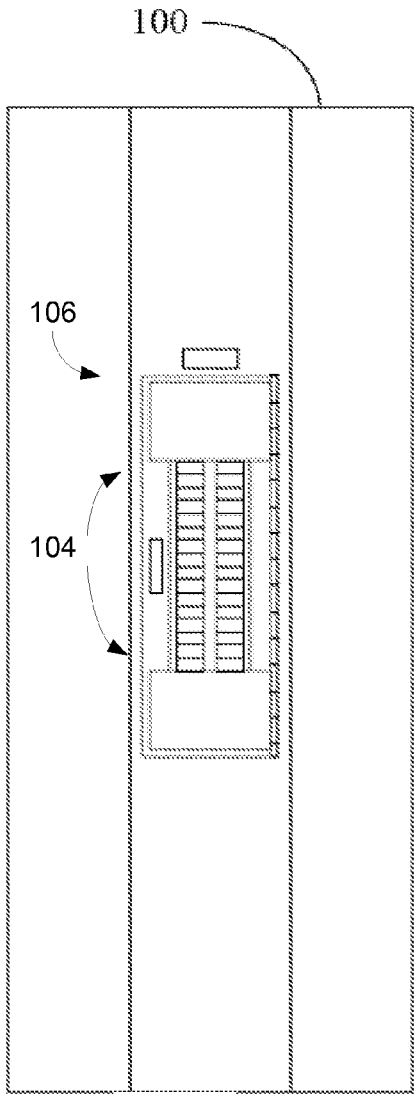
Figure 1C:
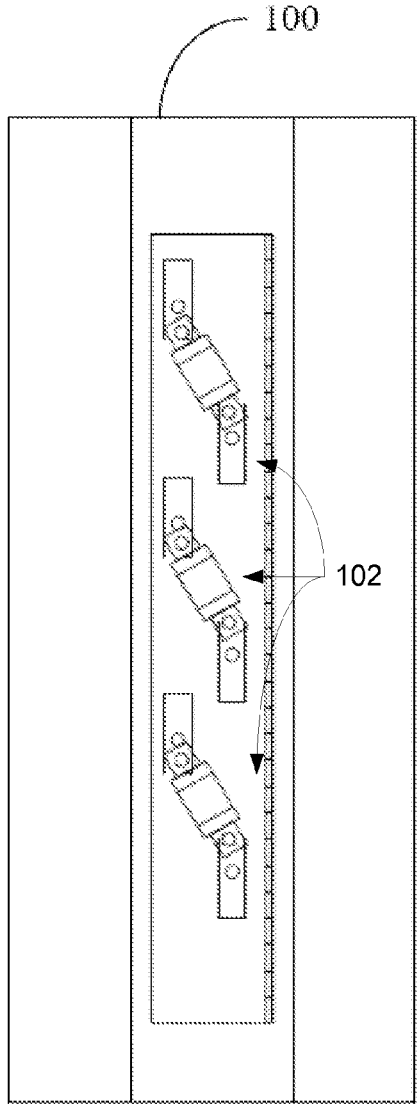

FIGS. 1A-C illustrate a physical housing 100 installation of a neutral deriving transformer that may include a local zig-zag transformer that may be octagonal in shape to allow for multiple different accessories to be installed. In some embodiments, a number of zig-zag transformers may be included in the same physical housing 100 or stacked on a concrete base. The physical housing 100 might enclose two or more zig-zag transformers stacked on the concrete base.

In some embodiments, such a system might service seven separate loads and provide one side of the cabinet for in-line fuses 102 or breakers 104 for phase-to-phase fault protection. The breakers 104 may be located in a service box 106. In addition to powering multiple loads the zig-zag transformer may be proximate in distance to distinct local load centers being supplied from the zig-zag transformer. This can be done to minimize cabling length to these local loads.

Additionally, the zig-zag transformer units can be installed near loads that produce large Triplen harmonic currents. Triplen harmonic currents can produce undesirable effects. Accordingly, the zig-zag connection in a power systems may be configured to trap Triplen harmonic currents (3rd, 9th, 15th, etc.) using the windings. Trapping the harmonic currents prevents the harmonic currents from traveling upstream to an electrical power source.

In some embodiments the neutral deriving transformer can include in-line fuses 102 or in-line circuit breakers 104 electrically in series with and connected to the three legs of the zig-zag transformer to protect a downstream load from phase-to-phase fault currents, for example, one fuse 102 might be connected to one of each of the three legs. The in-line fuses 102 or in-line circuit breakers 104 may be configured to disconnect current flow if a phase-to-phase fault currents occurs.

Additionally, the thickness and size of the coils of the transformer may be allowed to be kept within reason by the addition of these fuses which protect against the possibility of higher current of a phase-to-phase fault. Additionally, in some systems the coils comprises copper. Generally, in previous systems an isolation transformer in a power distribution unit might prevent a phase-to-phase fault from affecting a downstream load. In this case, the fuses protect against a phase-to-phase fault.

A multiple local zig-zag transformer system is cheaper and faster to build because a neutral wire stemming from the main building power connection to the Utility Grid need not be routed throughout the entire building. Rather, merely the three wires for each phase of the stepped down voltage are routed to each local zig-zag transformer, and the zig-zag transformer creates a local neutral for the loads connected to that zig-zag transformer. Each local zig-zag transformer may be located proximate to the associated loads and in general much closer to the loads than the main building power connection to the Utility Grid is located to those same loads.

In some embodiments, a multitude of zig-zag transformers may each provide a local neutral to a load being served by that particular zig-zag transformer. The multiple zig-zag transformers create easier fault isolation because a fault in the overall building's power distribution system will be isolated to the particular local zig-zag transformer powering a load where the fault occurs.

Additionally, lower I^2 R losses in delivering power from the grid to the load, due to the zig-zag transformer characteristics, can lower power use and, accordingly, an electric bill in kilowatts used. Additionally, lower capital cost might be expended to provide cooling units for the transformers. Cooling power costs may be decreased as well.

Figure 2:
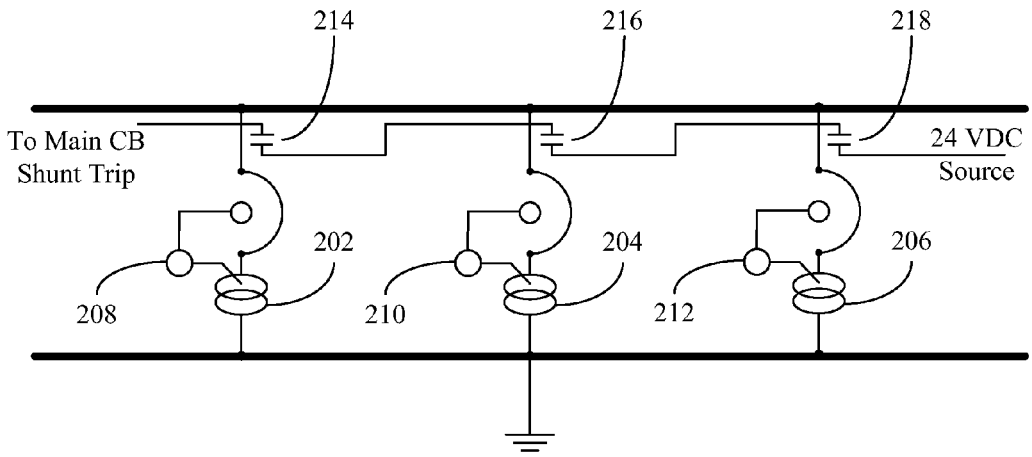
FIG. 2 illustrates a diagram of a grounded zig-zag transformer system in accordance with the systems and methods described herein.

FIG. 2 illustrates a diagram of an embodiment of a grounded zig-zag transformer system 200. In an example embodiment, the neutral deriving transformer is wired to create a return path for single phase loads for the three phase AC voltage lines routed to and conducting through the windings of zig-zag transformers 202, 204, and 206. The local zig-zag transformers 202, 204, and 206 derive a neutral and return path for all single phase loads connected to that local zig-zag transformer 202, 204, and 206.

The neutral deriving transformer system 200 illustrated in FIG. 2 may also have lower heat loses than an isolation transformer. Additionally, multiple zig-zag transformers 202, 204, and 206 may be stacked on top of each other in the same space that a single isolation transformer configuration would occupy. The neutral deriving transformer system 200 may include multiple coils in parallel to dissipate heat from current flow such that the stacked zig-zag transformers do not melt at a given current level like a stacked isolation transformer set would.

In a locally grounded configuration of a zig-zag transformer, the coils and windings of each local zig-zag transformer 202, 204, and 206 may also be configured both in size and electrical characteristics to have a specific voltage drop across the coils by having both a continuous winding without splices and coils that can be sized thick enough to create the voltage drop across the coils in case of a ground fault. This can protect the downstream loads from a damaging voltage spike during a ground fault. For example, the coils may provides enough of a voltage drop across the transformer during a ground fault condition that the downstream loads do not get destroyed by an over voltage condition.

Some embodiments may include a temperature sensor device 208, 210, and 212. Such a device might be placed in the windings of each zig-zag transformer 202, 204, and 206 to insure proper operation and prevent overheating. For example, each sensor 208, 210, and 210 can be connected to the corresponding shunt trip 214, 216, 218 for the corresponding transformer 202, 204, and 206. For example, a sensor 208, 210, or 212 at transformer 202, 204, or 206, respectively, may have a local audible and visual alarm and contacts for a remote alarm. Additionally, over temperature can open the supply circuit.

In an ungrounded system it may still be necessary to detect a ground fault. With the zig-zag transformer, you might insert a resistor between the neutral point and ground to limit ground fault current on the system. Additionally, in some examples of an ungrounded system, the coils may be sized as small as possible.

In some example systems, no drop resistor is attached. Thus, the coils may be sized large enough that they can act as a resistor to dissipate the heat of the current from the ground fault and not melt or deteriorate. In one example system, a continuous neutral current of 600 Amps consisting mainly of Triplen Harmonics may occur. In such an embodiment coils may be sized to be thick enough to dissipate the sum of (at least three and up to all of) the harmonics associated with the frequency of that voltage such as 60 Hz.

Additionally, FIG. 2 illustrates three zig-zag transformers supplying the same local area loads. Multiple zig-zag transformers 202, 206, and 208 in parallel can be used to give redundancy. This can reduce the power dissipated across each transformer 202, 206, and 208 which can reduce the size of each transformer and create smaller heat/current squared over resistance losses.

Some embodiments may include a small array of separately derived system grounds, using an array of zig-zag transformers. Each leg of each zig-zag transformer in the array of zig-zag transformers balances heating and the legs inductance parameter may be controlled to achieve a 120 degree shift so return currents meet at the same angle and velocity and in phase to cancel out. Some example systems may not incur any losses associate with the conventional method of utilizing isolation transformers.

Figure 3:
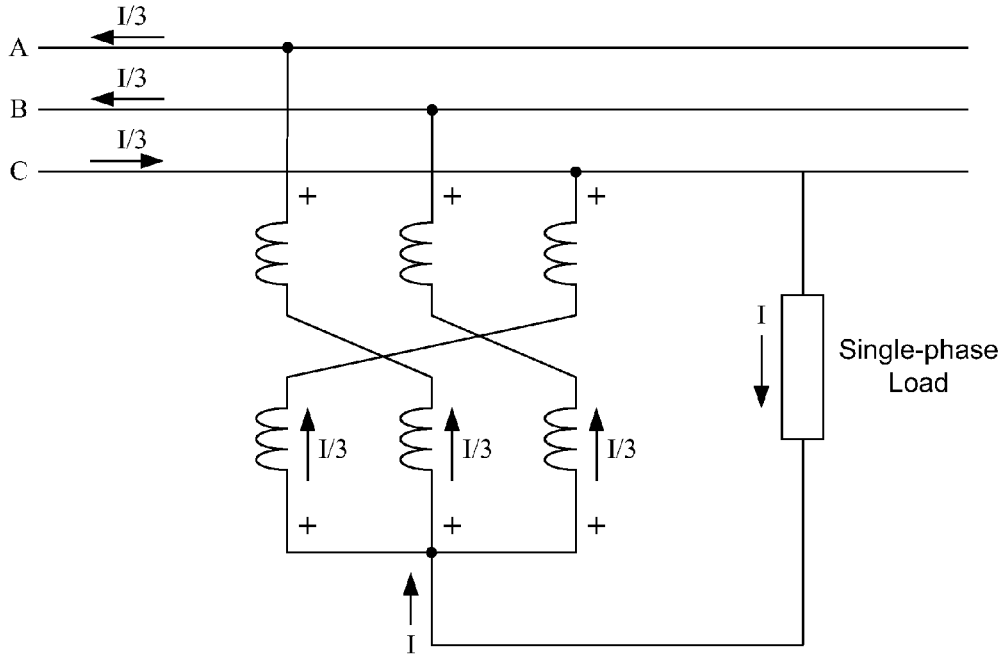
FIG. 3 illustrates a diagram of a zig-zag transformer system in accordance with the systems and methods described herein.

FIG. 3 illustrates a diagram of an embodiment of a zig-zag transformer system 300. The zig-zag transformer can be a phase shifting series autotransformer that allows a common point or neutral 302 to be created. This can provide a return path for zero sequence current generated by the loads in the system. The zig-zag transformer 304 may provide a return path for zero sequence current generated by the loads in the system. The ground connection may be removed and the zig-zag transformer neutral 302 may be connected to the bottom of the load 304.

Each of the three phases can be shifted approximately 120 degrees by the inductance of the windings for each leg of the transformer to provide the common neutral point 302. For example, each leg of the zig-zag transformer 304 can balance heating and leg inductance parameters to achieve a 120 degree shift so return currents meet at the same angle and velocity and in the same phase to cancel out. In some embodiments, the coils 306 used in the zig-zag transformer may be six-winding, two per phase wound in opposite directions. Additionally, the coils 306 may be dry-type and rated for continuous duty.

Additionally, wiring terminals suitable for connection as a neutral deriving transformer may be used. Some systems may derive a neutral from any of a building's main voltage step-down connections to the electrical utility grid. Some systems can derive a neutral from any of a building's main voltage step-down connections to a utility grid grounded 400 volt system. This may be done without directly grounding of the zig-zag transformer neutral back to ground at the utility or at an earth ground.

In some embodiments, one main zig-zag transformer 304 may provides a neutral 302 for a large number of load centers. The coils themselves may perform the function of a fault resistor. Additionally, the neutral deriving transformer 304 may include a thermal detector built into the zig-zag transformer. In some embodiments, the coils 306 of the zig-zag transformer 304 may also be sized large enough that they can also dissipate a maximum theoretical limit of current from Triplen harmonics and not melt or deteriorate. As illustrated in FIG. 3, the zig-zag transformer 304 may be installed in parallel with a system such that a set of coils 306 from the zig-zag transformer 304 is electrically in parallel with a load 308 of the zig-zag transformer 304. The set of coils 306 can provide a return path for current flowing through the load 308 of the zig-zag transformer.

Figure 4:
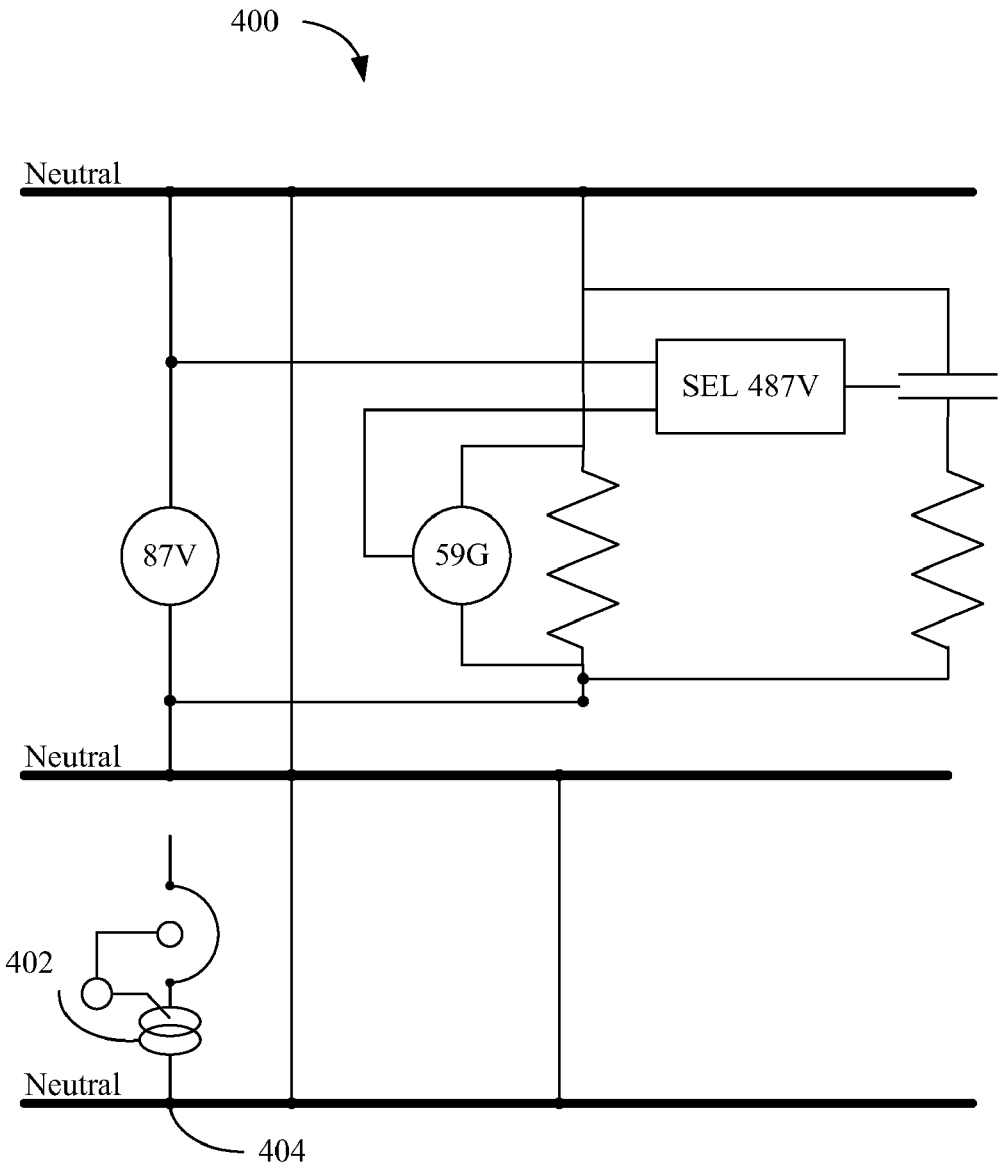
FIG. 4 illustrates a diagram of an ungrounded zig-zag transformer system in accordance with the systems and methods described herein.

FIG. 4 is a diagram illustrating a neutral deriving transformer 402 in an ungrounded configuration. In the ungrounded configuration a neutral or common point 404 of the windings of the zig-zag transformer 402 may be ungrounded. Such a system 400 might be used when no large current faults are expected. A grounded system may provide additional protection if a current fault occurs. Alternatively, such a system 400 might be used even when current faults are expected if the cost of shutting down the system is expected to be greater than the cost of potentially damaging the equipment. Additionally, in some embodiments, the coils may have the lowest possible impedance. The impedance can be controlled by a number of turns for the windings of the zig-zag transformer 402. These coils can be made from a material such as copper or other materials.

Figure 5A:
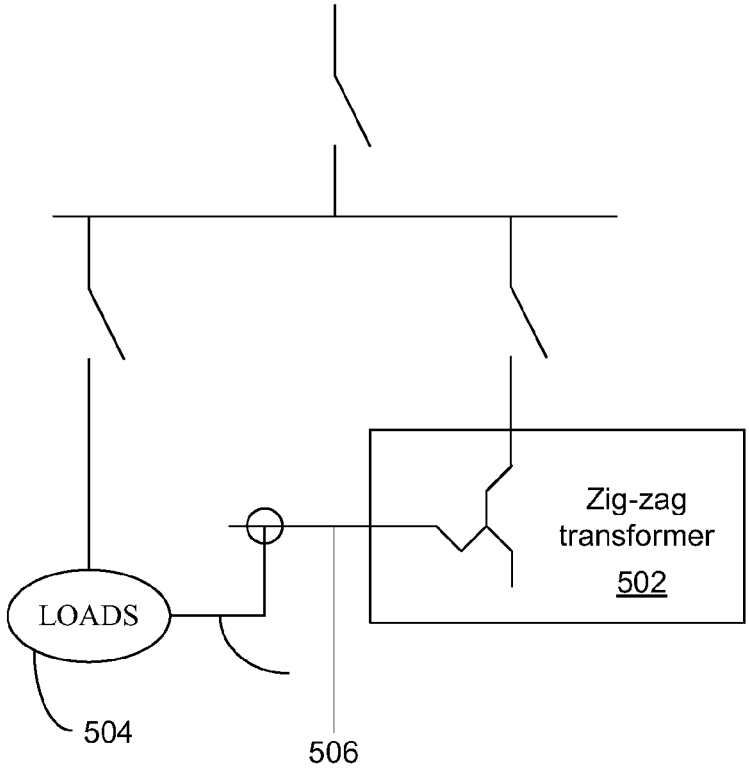
FIGS. 5A and 5B illustrate diagrams of zig-zag transformers in accordance with the systems and methods described herein.
Figure 5B:
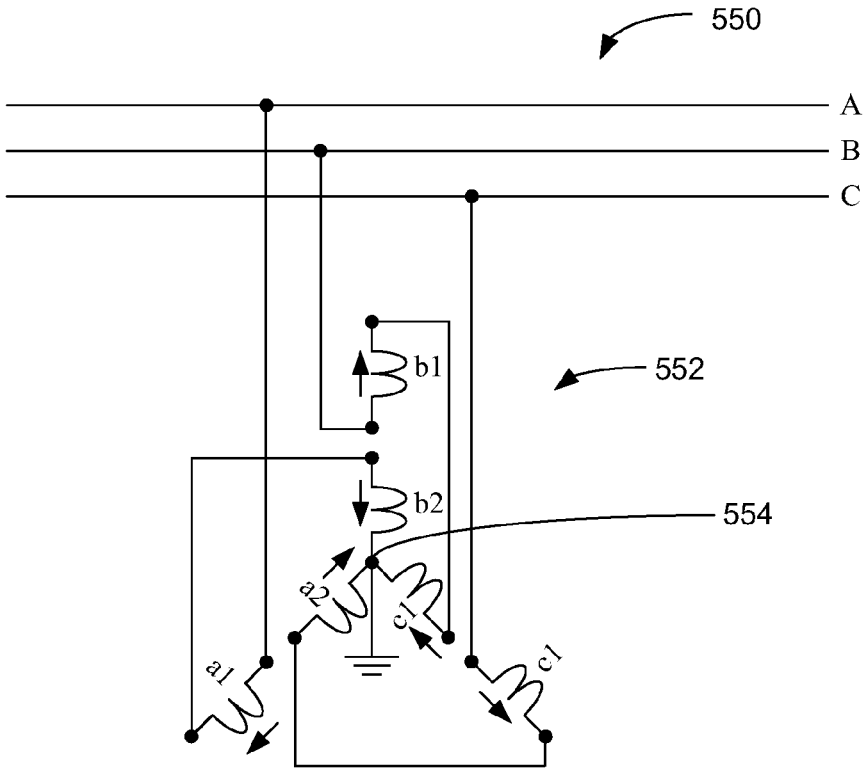

FIGS. 5A and 5B are diagrams illustrating neutral deriving transformers 500 and 550 incorporating zig-zag transformer configurations. For example, an electrical power distribution system may include a zig-zag transformer 502 providing an electrical load 504 with a neutral wire 506. The zig-zag transformer 502 can be electrically connected downstream of a main AC voltage step-down transformer. Additionally, three phase AC voltage lines can be routed to the zig-zag transformer 502 such that the zig-zag transformer 502 electrically connects to a ground conductor that ties back to a ground for the main voltage step-down transformer. The neutral deriving transformer 502 might not be electrically connected to a neutral conductor of the main voltage step-down transformer, however. Rather, the zig-zag transformer 502 may phase shift each winding by approximately 120 degrees such that the zig-zag transformer 502 is a phase shifting series autotransformer that derives a neutral for all single phase load connections to the zig-zag transformer 502 and all of the three phase AC lines in order to provide a common neutral point that takes the place of a neutral cable that electrically connects back to the neutral conductor of the main voltage step-down transformer. Phase shifting can be used to achieve a common neutral point 554 for all three phases. For example with the b1 to c1 connection shows phase shifting and c1 and c2 connections show currents going in the opposite direction to cancel or reduce heat losses, e.g., current squared times the resistance losses.

Additionally, the zig-zag transformer 552 can be electrically connected into a building's power distribution system downstream of the building's main voltage step-down connection to the Electric Power Utility grid. In such a system a circuit breaker may be a 3 pole breaker electrically coupled to the zig-zag transformer 552, rather than a 4 pole breaker, which may cost more.

Some embodiments relate to a method of providing a neutral derived from a transformer incorporating a zig-zag transformer configuration. In such a method a zig-zag transformer system might be provided as described herein. The method can include electrically connecting the system back to the neutral conductor of the main voltage step-down transformer. Additionally, the method may include electrically connecting the zig-zag transformer into a building's power distribution system downstream of the building's main voltage step-down connection to the Electric Power Utility grid.

Figure 6:
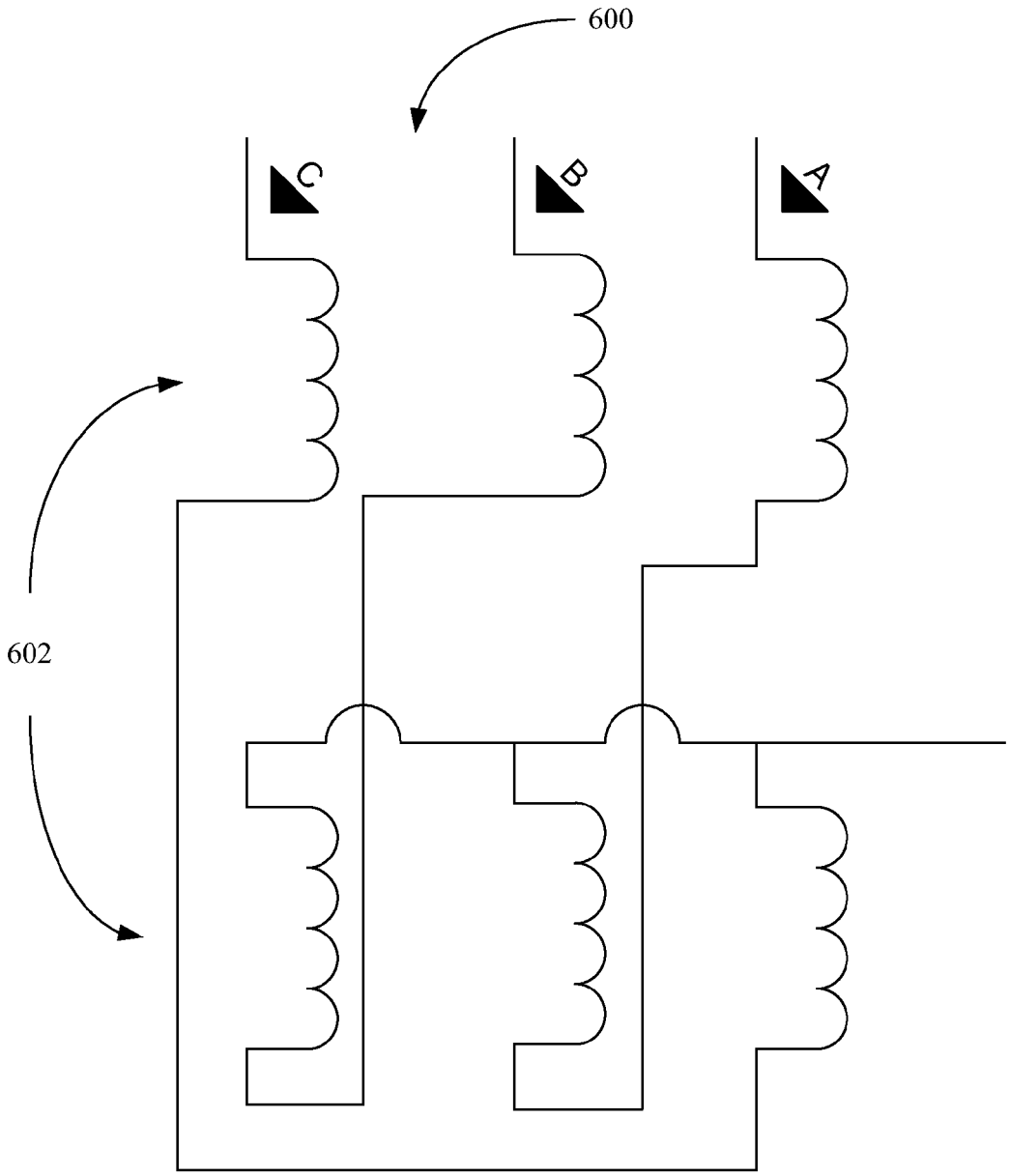
FIG. 6 illustrates a diagram of an ungrounded zig-zag transformer system in accordance with the systems and methods described herein.

FIG. 6 is a diagram illustrating a zig-zag transformer 600 configuration in accordance with the systems and methods described herein. In one example, the cores of the transformer 600 may comprise grain-oriented, non-aging silicon steel that may help with efficiency and minimizing heat losses. Additionally, internal coil 602 connections may be brazed or welded connections that can decrease the actual internal resistance of the windings of the transformer and provide for less current and heat loss during regular operation. Additionally, in some embodiments, the coil material might be copper.

Figure 7B:
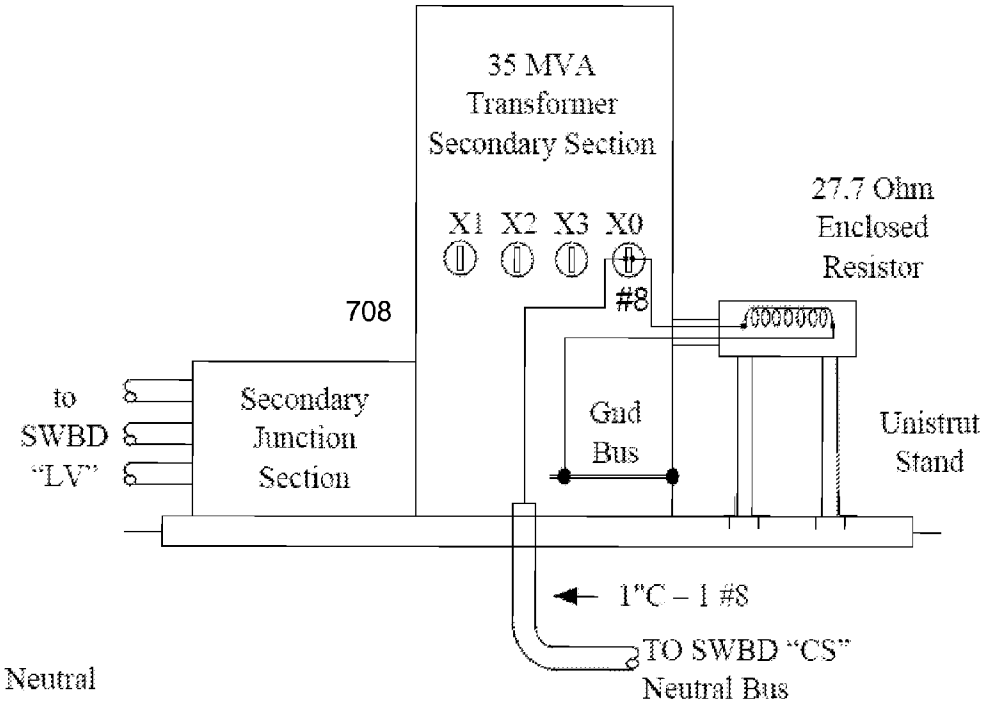
FIGS. 7A and 7B illustrate diagrams of a grounding schematic and connection details in accordance with the systems and methods described herein.
Figure 7A:
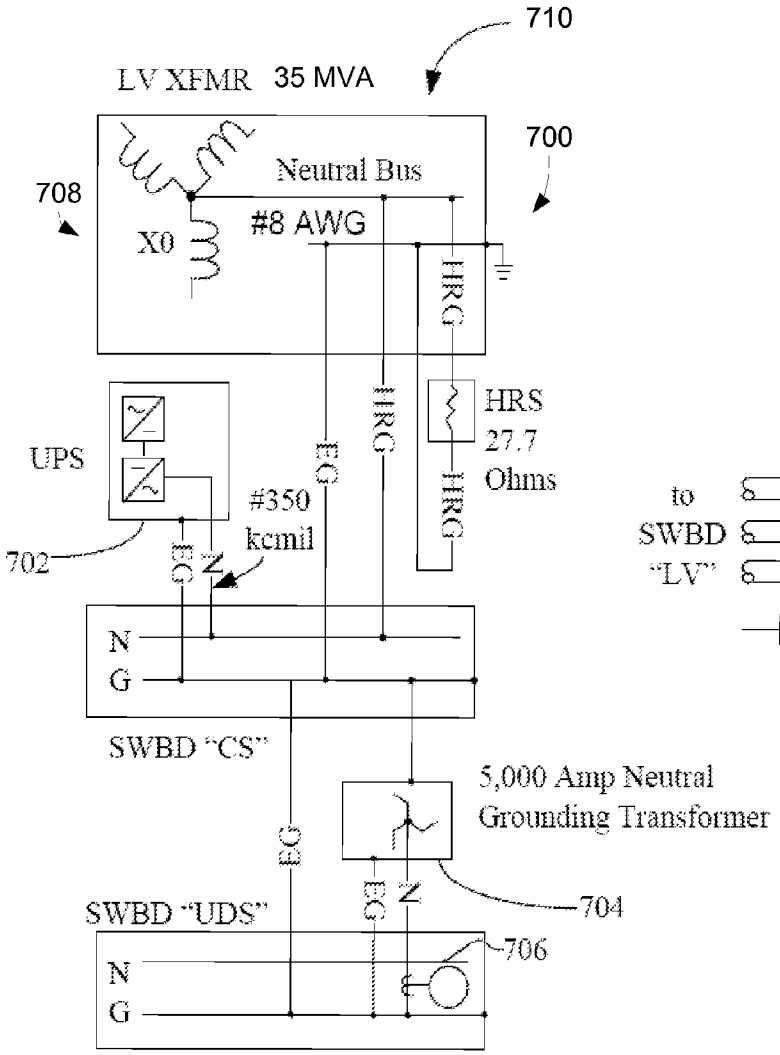

FIG. 7A is a diagram illustrating an example grounding schematic and FIG. 7B is a diagram illustrating connection details. Some embodiments may eliminate the neutral conductor in parts of the low voltage distribution system and derive a new neutral. This may be accomplished without incurring significant heat and electrical losses. Eliminate the neutral conductor may be done at a distribution system such as a "UDS" Switchboards by means of a zig-zag transformer.

Unlike a traditional electrically isolated series connected transformer, the zig-zag transformer 704 may be installed in parallel with the system. Additionally, the zig-zag transformer based system 700 may eliminate the need for pulling cable for a high resistance-to-ground wire and connecting to the neutral bus conductor (labeled Neutral Bus) from the three phases off the Electric Power Grid to the neutral of the local switchboard 706.

In some embodiments, the high resistance-to-ground connection connects to the building main switchboard or circuit breaker box. Additionally, a neutral of a main uninterruptible power supply 702 may tie back to the Electric Power Grid. An earth ground might be pulled for the local switchboard and the zig-zag transformer 704 may derive a local neutral 706 for the equipment being supplied by that local switchboard. A RPP/Switch board design utilizing an integrated zig-zag transformer to derive a neutral may be used. This integrated zig-zag transformer can allow for the creation of a utilization system with a separately derived neutral without having to incur the losses associated with the isolation transformers. Additionally, unlike a traditional electrically isolated, in the instant application a series connected transformer may be used.

A normal transmission system consists of only "Positive Sequence" Voltage. When this transmission system serves loads (i.e. computer racks, UPS', lights, etc.) a "Negative Sequence" component is introduced into the distribution system. In a balanced system the Positive and Negative sequence components are of equal but opposing magnitudes and cancel each other out. If there is a remainder or an imbalance (such as in a ground fault or large single phase loads) that current returns to the source in the form of "Zero Sequence" current. In a closed loop distribution system where there are balanced phase currents the resultant zero sequence current is zero. Below is the equation for determining Zero sequence current.

$$ZO=a\ b\ c/3$$

When there are equal zero sequence currents flowing into the terminals of a zig-zag transformer they produce no magnetizing effect since they flow in opposite directions in the two windings of each core. The positive sequence component of phase A flows in one direction while an equal negative sequence component of phase B flows in the opposite direction on the same leg, and since they are attached to the same core, the net zero sequence magneto-motive force acting on the core is zero. This essentially means that there will be no zero sequence current flowing on the star connected secondary winding. Unlike a traditional electrically isolated, series connected transformer the zig-zag is installed in parallel with the system. What this essentially means is that there will be no losses associated with the addition of the zig-zag in a balanced 3 phase system.

In some embodiments the system may interrupt supply system breaker upon over current on the transformer, disengaging phase conductors first, followed by disconnection of the NCP. The system may utilize current sensors and overload relays on the phase and neutral connection points to effect tripping sequence.

An example system may be rated, for an example, for a neutral to phase converter of 600 V and less, with capacities up to 600 amp 400/230 volts and continuous Neutral Current of 600 Amps consisting mainly of Triplen Harmonics Coils may be sized to be thick enough to dissipate the sum of (at least three and up to all of) the harmonics associated with the frequency that voltage such as 60 Hz. Additionally, a K-factor of 9 and a significantly greater amount of copper to iron to assist in the K factor.

Some example systems may have an input voltage of 400 volts, 3 wire and a system output voltage of 400 V or 231 V, 3 phase, 4 wire. The frequency of some example systems can be 60 Hz. Winding conductors can be copper and an insulation system may be used.

In some systems, the temperature rise may be 80 degrees, line conductors for 400 amps, and a neutral current 90 amps phase unbalanced current plus 600 amps Triplen Harmonic current may be used. Additionally, zero phase sequence reactance may be less than 0.2%.

In some embodiments, installation may be performed by constructing concrete bases and anchoring floor-mounting for locating the transformers providing the neutral wire for local loads as close as is reasonable to service all of the local loads.

In some embodiments, a neutral deriving transformer may be used in combination with a Remote Power Panels (RPP) and Power Distribution Units (PDU's). The system may be used to connect neutral deriving transformers to provide nameplate voltage of load equipment being served, plus or minus 5 percent, at secondary terminals. The zig-zag transformer is a phase shifting series autotransformer that allows a common point or neutral to be created. This provides a return path for zero sequence current generated by the loads in the system.

A normal transmission system may include a "positive sequence" voltage. When this transmission system serves loads (e.g., computer racks, UPS', lights, etc.) a "negative sequence" component can be introduced into the distribution system. In a balanced system, positive and negative sequence voltage components are of equal but opposing magnitudes and cancel each other out. If there is a remainder or an imbalance (such as in a ground fault or large single phase loads) that current may return to the source in the form of "zero sequence" current. In a closed loop distribution system where there are balanced phase currents the resultant zero sequence current is zero. Zero sequence current is given by: ZO=phases a b c/3.

As discussed, essentially there will be no losses associated with the addition of a zig-zag in a balanced 3 phase system. In the table below, typical losses associated with dry-type 80° C. rise dry-type class H transformers are given.

In a normal full load operation you would not see any of these losses due to the lack of magnetomotive required to create excitation current in the core. The losses illustrated below would be in a worst case single phase imbalance scenario. Zig-zag transformers are rated based on the current carrying capacity of the wire and the below values are used to illustrate worst case.

| kVA No Load | Watt Loss Full Load | Watt Loss Typical | X/R |
|---|---|---|---|
| 300 | 1800 | 7600 | 2.10 |
| 500 | 2300 | 9500 | 3.87 |
| 750 | 3400 | 13000 | 4.38 |
| 1000 | 4200 | 13500 | 6.10 |

In some embodiments, this is where the operational savings are realized. Using I^2R for a run with Icurrent=1688 Amps and resistance 0.019*139/1000 for a standard 750kcmil cable run at 139' the calculated continual watts loss is 7,408.29 watts. These losses would be calculated per neutral feeder. In a single 5 UPS system there is the potential for continual heat losses in excess of 114 kW. This figure would increase for bypass and maintenance conditions. Taking 114 kW per system multiplied by 6 systems then adding an additional 15kW of losses for LV SWGR input, CS Output and Maintenance. Bypass (75 kW) and multiply that by six systems yields a continual loss of 1.3 MW. Compare that to the worst case 7.6 kW of losses per system in the event of full imbalance and 0kW of losses in the normal operating condition. At a rate of $0.03 kW/h that is an annual operational savings of nearly $60,000.00 per UPS system or $360,000.00 over the 6 systems. Thus, the multiple local zig-zag transformer system is cheaper and faster to build because a neutral wire (labeled Neutral Bus) stemming from the main building power connection 708 to the Utility Grid need not be routed throughout the entire building. Rather, merely the three wires for each phase of the stepped down voltage are routed to each local zig-zag transformer 704, and the zig-zag transformer 704 creates a local neutral 706 for the loads connected to that zig-zag transformer 704. Each local zig-zag transformer 704 may be located proximate to the associated loads and in general much closer to the loads than the main building power connection 708 to the Utility Grid is located to those same loads.

The whole system may be more electrically efficient and thus have less heat losses and current losses. The multiple local zig-zag transformer system creates many small locally isolated load center systems which can lead to easier identification of local faults.

One embodiment can include a Conductor, Length, Tail, Wire Size, # of C, Impedance per 1000 ft, and an impedance run of a neutral of: 124, 15, 750, 14, XL, 0.038 R, 0.019 PF, 0.9 Z, 0.042968, 0.005972516.

Additional savings come in the form of reduction of the capital expenditures of copper and man-hours. The reductions for removing the neutral from the system starting from the low voltage transformers all the way down to the "UDS" Switchboard are substantial.

A zig-zag transformer 704 is a transformer with a zig-zag arrangement with primary windings but no secondary winding. The zig-zag transformer 704 derives a common reference point for an ungrounded electrical system. Thus, a way of grounding the system is by using a zig-zag transformer 704. As a three-phase transformer, the zig-zag transformer 704 contains six coils on three cores. The first coil on each core is connected contrariwise to the second coil on the next core. The second coils are then all tied together to form the neutral and the phases are connected to the primary coils. These winding halves interconnect to obtain a zig-zag arrangement. Each phase, therefore, couples with each other phase and the voltages cancel out. Likewise, the windings on each phase of a zig-zag transformer 704 connect in two halves. With the zig-zag connection, the currents in the two halves of the windings on each leg of the transformer flow in opposite directions. As such, there would be negligible current through the neutral pole and it can be tied to ground.

If one phase, or more, faults to earth, the voltage applied to each phase of the transformer is no longer in balance; fluxes in the windings no longer oppose. Zero sequence (earth fault) current exists between the transformer's neutral to the faulting phase. With negligible current in the neutral under normal conditions, engineers typically elect to under size the transformer i.e.; a short time rating is applied (i.e., the transformer can only carry full rated current for, say, 60 s). However, in the current design the coils are sized thick enough to create a voltage drop to protect downstream loads in a fault condition.

The zig-zag windings may achieve a vector phase shift. Generally, the common portion of an autotransformer (low voltage) can be the common winding, and the remainder can be the series winding. (Together these make up the high voltage side of the transformer.) You can use the zig-zag transformer in two winding transformer applications, where you obtain voltage transformation and isolation with the zig-zag feature.

Due to its composition, the zig-zag transformer 704 may be more effective for grounding purposes because it has less internal winding impedance going to the ground than when using a wye-type transformer.

The neutral deriving transformer may incorporate a zig-zag transformer configuration. For example, an electrical power distribution system may include a zig-zag transformer 704 providing an electrical load with a neutral wire. The zig-zag transformer 704 can be electrically connected downstream of a main AC voltage step-down transformer 710. Additionally, three phase AC voltage lines can be routed to the zig-zag transformer 704 such that the zig-zag transformer 704 comprises a neutral deriving transformer that electrically connects to a ground conductor. The ground conductor (labeled EG) may tie back to a ground for the main AC voltage step-down transformer 710. In some embodiments, the neutral deriving transformer does not electrically connect to a neutral conductor (labeled Neutral Bus) of the main voltage step-down transformer 710. The zig-zag transformer 704 phase shifts each winding by approximately 120 degrees such that the zig-zag transformer 704 is a phase shifting series autotransformer that derives a neutral for all single phase loads connected to both the zig-zag transformer and all of the three phase AC lines in order to provide a common or neutral point that takes the place of a neutral cable that electrically connects back to the neutral conductor (labeled Neutral Bus) of the main AC voltage step-down transformer 710. Additionally, the zig-zag transformer 704 can be electrically connected into a building's power distribution system 700 downstream of the building's main AC voltage step-down transformer connection 708 to the Electric Power Utility grid.

While some specific embodiments of the invention have been shown the invention is not to be limited to these embodiments. For example, most functions performed by electronic hardware components may be duplicated by software emulation. Thus, a software program written to accomplish those same functions may emulate the functionality of the hardware components in input-output circuitry. The invention is to be understood as not limited by the specific embodiments described herein, but only by scope of the appended claims.

I claim:

1. A neutral deriving transformer incorporating a zig-zag transformer configuration, comprising:

a zig-zag transformer providing an electrical load with a neutral wire, the zig-zag transformer electrically connected downstream of a main AC voltage step-down transformer and wherein three phase AC voltage lines are routed to the zig-zag transformer such that the zig-zag transformer comprises a neutral deriving transformer that electrically connects to a ground conductor that ties back to a ground for the main AC voltage step-down transformer but wherein the neutral deriving transformer does not electrically connect to a neutral conductor of the main AC voltage step-down transformer, wherein the zig-zag transformer phase shifts each winding by approximately 120 degrees such that the zig-zag transformer is a phase shifting series autotransformer that derives a neutral for at least one single phase load connected to the zig-zag transformer and one of the three phase AC lines in order to provide a common neutral point that takes a place of a neutral cable that electrically connects back to the neutral conductor of the main AC voltage step-down transformer, and wherein the zig-zag transformer is electrically connected into a building's power distribution system downstream of the building's main AC voltage step-down transformer's connection to an Electric Power Utility grid.

2. The neutral deriving transformer of claim 1, wherein the zig-zag transformer is wired such that a return path is created for all single phase loads for the three phase AC voltage lines routed to and conducting through the windings of the zig-zag transformer; and thus, the zig-zag transformer derives a neutral and return path for all single phase loads connected to that local zig-zag transformer, and where the zig-zag transformer has six-windings, two per AC voltage phase that are wound in opposite directions; and thus, a first coil on each core is connected contrariwise to a second coil on a next core.

3. The neutral deriving transformer of claim 1, wherein the zig-zag transformer is installed in parallel with a system such that a set of coils from the zig-zag transformer is electrically in parallel with the at least one single phase load of the system, the set of coils providing a return path for current flowing through the at least one single phase load serviced by the zig-zag transformer and a three pole breaker electrically connects to the zig-zag transformer.

4. The neutral deriving transformer of claim 1, wherein a physical housing installation of the zig-zag transformer is octagonal in shape to allow for multiple different accessories to be installed, wherein the zig-zag transformer may power multiple loads, and the zig-zag transformer is proximate in distance to distinct local load centers being supplied from the zig-zag transformer to minimize cabling length to these local loads.

5. The neutral deriving transformer of claim 1, further comprising:

multiple zig-zag transformers that are stacked on top of each other, rather than a single zig-zag transformer, in a same space that a single isolation transformer configuration would occupy, the neutral deriving transformer including its multiple coils configured in parallel to dissipate heat from current flow such that the stacked zig-zag transformers do not melt at a given current level equivalent to an amount of power the single isolation transformer would provide.

6. The neutral deriving transformer of claim 1, further comprising:

a locally grounded configuration of the zig-zag transformer, wherein coils and windings of each zig-zag transformer are configured both in size and electrical characteristics to have a specific voltage drop across the coils by having both a continuous winding without splices and the coils are sized thick enough to create the voltage drop across the coils in case of a ground fault to protect the downstream loads from a damaging voltage spike during a ground fault.

7. The neutral deriving transformer of claim 1, further comprising:

an ungrounded configuration of the zig-zag transformer, wherein a neutral common point of the windings of the zig-zag transformer is ungrounded, coils of the zig-zag transformer have a low impedance of controlled by a number of turns for the windings of the zig-zag transformer and an amount of copper making up the windings.

8. The neutral deriving transformer of claim 1, further comprising:

in-line fuses or in-line circuit breakers electrically in series with and connected to each leg of the zig-zag transformer to protect a downstream load from phase-to-phase fault currents, wherein the in-line fuses are configured to disconnect current flow if a phase-to-phase fault currents occurs.

9. The neutral deriving transformer of claim 1, wherein each leg of the zigzag transformer balances heating and that leg's inductance parameter to achieve approximately a 120 degree shift so return currents meet at a same angle and velocity and in phase to cancel out, and wherein coils of the zigzag transformer are also sized large enough that they can also dissipate a maximum theoretical limit of current from Triplen harmonics and not melt or deteriorate.

10. The neutral deriving transformer of claim 1, wherein the zig-zag transformer provides a neutral for a large number of load centers, coils of the zigzag transformer themselves perform the function of a fault resistor to protect those load centers, wherein the neutral deriving transformer includes a thermal detector built into the zig-zag transformer to assist with tripping an associated in-line switch upon detection of an over current condition, and wherein cores of the zigzag transformer comprises a grain-oriented, non-aging silicon steel, and internal coil connections comprises brazed or welded connections in order to control an inductance parameter of windings of the zigzag transformer under a set limit.

11. The neutral deriving transformer of claim 1, wherein a multitude of zig-zag transformers each provide a local neutral to a load being served by that particular zig-zag transformer, and the multiple zig-zag transformers each isolate a fault to the particular zig-zag transformer powering a load where the fault occurs.

12. The neutral deriving transformer of claim 1, wherein a shape of a cabinet containing the zig-zag transformer is octagonal to service seven separate loads, and wherein one side of the cabinet is used for in-line fuses or breakers for phase-to-phase fault protection, and coils of the zig-zag transformer comprise one of made of purely copper, and made of a significantly greater amount of copper to iron.

13. The neutral deriving transformer of claim 1, further comprising:

an ungrounded system, and wherein a resistor in the neutral deriving transformer is located between a neutral point and ground to limit ground fault current on the ungrounded system.

14. The neutral deriving transformer of claim 1, wherein the zig-zag transformer units are installed near loads that produce large Triplen harmonic currents, and the zig-zag transformer connection in a power system are configured to trap Triplen harmonic currents using windings of the zig-zag transformer, wherein trapping the harmonic currents prevents the harmonic currents from traveling upstream to an electrical power source.

15. A method of providing a neutral derived from a transformer incorporating a zig-zag transformer configuration, comprising:

providing a zig-zag transformer and an electrical load with a neutral wire, the zig- zag transformer electrically connected downstream of a main AC voltage step-down transformer, and wherein three phase AC voltage lines are routed to the zig-zag transformer such that the zig-zag transformer comprises a neutral deriving transformer that electrically connects to a ground conductor that ties back to a ground for the main AC voltage step-down transformer but wherein the neutral deriving transformer does not electrically connect to a neutral conductor of the main AC voltage step-down transformer, wherein the zig-zag transformer phase shifts each winding by approximately 120 degrees such that the zig-zag transformer is a phase shifting series autotransformer that derives a neutral for at least one single phase load connected to the zig-zag transformer in order to provide a common local neutral point that takes the place of a neutral cable that electrically stems from the neutral conductor of the main voltage step-down transformer connecting to an Electric Power Utility Grid; and electrically connecting the zig-zag transformer into a building's power distribution system downstream of the building's main AC voltage step-down transformer connection to the Electric Power Utility grid.

16. The method of claim 15, wherein the zig-zag transformer comprises a grounded zig-zag transformer, and wherein windings of the transformer are brazed or welded to decrease an internal resistance of the zig-zag transformer.

17. The method of claim 15, the method further comprising: using an ungrounded zig-zag transformer on a system when large current faults are not expected.

18. The method of claim 15, wherein the method further comprises using multiple zig-zag transformers in parallel to give redundancy, and a reduction in an amount of power dissipated across each transformer.

19. The method of claim 15, further comprising; creating an array of separately derived system grounds, using an array of zig-zag transformers, wherein each leg of each zig-zag transformer in the array of zig-zag transformers balances heating and the leg's inductance parameter is controlled to achieve a 120 degree shift so return currents meet at a same angle and velocity and in a same phase to cancel out.

20. The method of claim 15, further comprising; deriving a neutral from any of a building's main AC voltage step-down transformer connections to a utility grid grounded 400 volt system in an ungrounded zig-zag transformer system with an ungrounded neutral.

* * * * *